US012663226B2

(12) United States Patent
Yu et al.

(10) Patent No.: US 12,663,226 B2
(45) Date of Patent: Jun. 23, 2026

(54) SELF-ADAPTIVE THERMAL MANAGEMENT SYSTEMS AND METHODS THEREOF

(71) Applicant: Toyota Motor Engineering & Manufacturing North America, Inc., Plano, TX (US)

(72) Inventors: Ziqi Yu, Ann Arbor, MI (US); Xiaopeng Li, Ann Arbor, MI (US); Ercan M. Dede, Ann Arbor, MI (US); Taehwa Lee, Ann Arbor, MI (US)

(73) Assignees: Toyota Motor Engineering & Manufacturing North America, Inc., Plano, TX (US); Toyota Jidosha Kabushiki Kaisha, Toyota (JP)

( * ) Notice: Subject to any disclaimer, the term of this patent is extended or adjusted under 35 U.S.C. 154(b) by 224 days.

(21) Appl. No.: 18/381,449

(22) Filed: Oct. 18, 2023

(65) Prior Publication Data

US 2025/0129999 A1 Apr. 24, 2025

(51) Int. Cl.

| | |
|---|---|
| ***F28F 13/18*** | (2006.01) |
| ***F25B 23/00*** | (2006.01) |
| *F28F 13/00* | (2006.01) |

(52) U.S. Cl.

CPC ..... *F28F 13/18* (2013.01); *F25B 23/003* (2013.01); *F28F 2013/008* (2013.01); *F28F 2245/06* (2013.01)

(58) Field of Classification Search

CPC ..... F25B 23/003; F25D 31/00; F28F 13/18; F28F 2013/005; F28F 2013/008; F28F 2245/06

See application file for complete search history.

(56) References Cited

U.S. PATENT DOCUMENTS

| | | | | |
|---|---|---|---|---|
| 12,228,353 | B2 * | 2/2025 | Yu | F28F 27/00 |
| 12,339,075 | B2 * | 6/2025 | Yu | B82Y 30/00 |

(Continued)

FOREIGN PATENT DOCUMENTS

| | | | | |
|---|---|---|---|---|
| CN | 109405625 A | * | 3/2019 | F28F 13/00 |
| CN | 111609750 A | * | 9/2020 | F28F 13/02 |

(Continued)

OTHER PUBLICATIONS

Yu et al., "Near-field radiative heat transfer in three-body Weyl semimetals", Optics Express, Aug. 15, 2022, vol. 30, No. 18, pp. 31584-31601.

*Primary Examiner* — Eric S Ruppert
*Assistant Examiner* — Hans R Weiland
(74) *Attorney, Agent, or Firm* — Dinsmore & Shohi LLP

(57) ABSTRACT

Embodiments described herein relate to a self-adaptive thermal management system. The thermal management system includes a first body, a second body, and a third body. The second body has a first layer and a second layer formed from a Weyl semimetal and a third layer sandwiched between the first layer and the second layer. The third layer is formed from a vanadium dioxide film. The second body is spaced apart from the first body. The third body is spaced apart from the second body. The second body is a modulator configured to transition between a metallic phase and an insulating phase dependent on a temperature to regulate a heat from the first body to the third body through the second body in a self-adaptive manner dependent on the temperature.

20 Claims, 8 Drawing Sheets

(56) References Cited

U.S. PATENT DOCUMENTS

| | | | | |
|---|---|---|---|---|
| 2003/0196454 | A1* | 10/2003 | Jin | C03C 17/3417 65/30.11 |
| 2016/0112050 | A1* | 4/2016 | Gotsmann | F28F 13/00 331/66 |
| 2020/0269999 | A1* | 8/2020 | Jankovic | B32B 3/30 |

FOREIGN PATENT DOCUMENTS

| | | | | |
|---|---|---|---|---|
| CN | 112331765 | A | 2/2021 | |
| CN | 113031312 | A | 6/2021 | |
| GB | 2514615 | A | 12/2014 | |
| KR | 20050059010 | A | 6/2005 | |
| WO | 2014034374 | A1 | 3/2014 | |
| WO | WO-2024063816 | A2 * | 3/2024 | F25B 21/00 |

* cited by examiner

SELF-ADAPTIVE THERMAL MANAGEMENT SYSTEMS AND METHODS THEREOF

TECHNICAL FIELD

The present specification generally relates to thermal management based on heat radiation, and more particularly, to near-field radiative heat transfer.

BACKGROUND

Passive radiative cooling, as one of the radiation-based thermal management techniques, is known for improving energy efficiencies by providing a path to dissipate heat from a structure into an atmosphere. Further, it is known to use radiative cooling via pigmented paints, dielectric coating layers, metallized polymer films, and organic gases because of their intrinsic thermal emission properties. Additionally, known thermal switch devices may be designed by placing two parallel Weyl semimetal planar objects distancing a nanoscale gap and rotating one object with respect to the other. As the rotation angle increases, the amount of heat transfer will decrease. However, such designs do not permit for automatic change in thermal switching properties in combination with rotation of the bodies.

SUMMARY

In one embodiment, a thermal cooling system is provided. The thermal cooling system includes a first body, a second body, and a third body. The second body has a first layer and a second layer formed from a Weyl semimetal and a third layer sandwiched between the first layer and the second layer. The third layer is formed from a vanadium dioxide film. The second body is spaced apart from the first body. The third body is spaced apart from the second body. The second body is a modulator configured to transition between a metallic phase and an insulating phase dependent on a temperature to regulate a heat from the first body to the third body through the second body in a self-adaptive manner dependent on the temperature.

In another embodiment, a method for forming a thermal cooling system is provided. The method includes positioning a first body having a first plurality of Weyl semimetal nanostructures, positioning a second body spaced apart from the first body, the second body having a first layer and a second layer formed from a Weyl semimetal and a third layer sandwiched between the first layer and the second layer, the third layer formed from a vanadium dioxide film; and positioning a third body having a second plurality of Weyl semimetal nanostructures. Wherein the second body is a modulator configured to transition between a metallic phase and an insulating phase dependent on a temperature to regulate a heat from the first body to the third body through the second body in a self-adaptive manner dependent on the temperature.

In yet another embodiment, a thermal cooling system is provided. The thermal cooling system includes a first body, a second body, and a third body. The first body is configured as a heat source that transfers heat and has first plurality of Weyl semimetal nanostructures. The second body has a first layer and a second layer formed from a Weyl semimetal and a third layer sandwiched between the first layer and the second layer. The third layer is formed from a vanadium dioxide film. The second body is spaced apart from the first body. The second body is a heat modulator configured to transition between a metallic phase and an insulating phase dependent on a temperature. The third body has a second plurality of Weyl semimetal nanostructures. The third body is spaced apart from the second body. The second body is positioned between the first body and the third body. The third body is a heat sink configured to receive the heat when the second body is in the insulating phase. Wherein the first body, the second body, and the third body are each configured to independently rotate with respect to a common axis to change optical properties of the first plurality of Weyl semimetal nanostructures, optical properties of the second plurality of Weyl semimetal nanostructures, and optical properties of the Weyl semimetal and the second body is configured to regulate a heat from the first body to the third body through the second body in a self-adaptive manner dependent on the temperature.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

Figure 1:
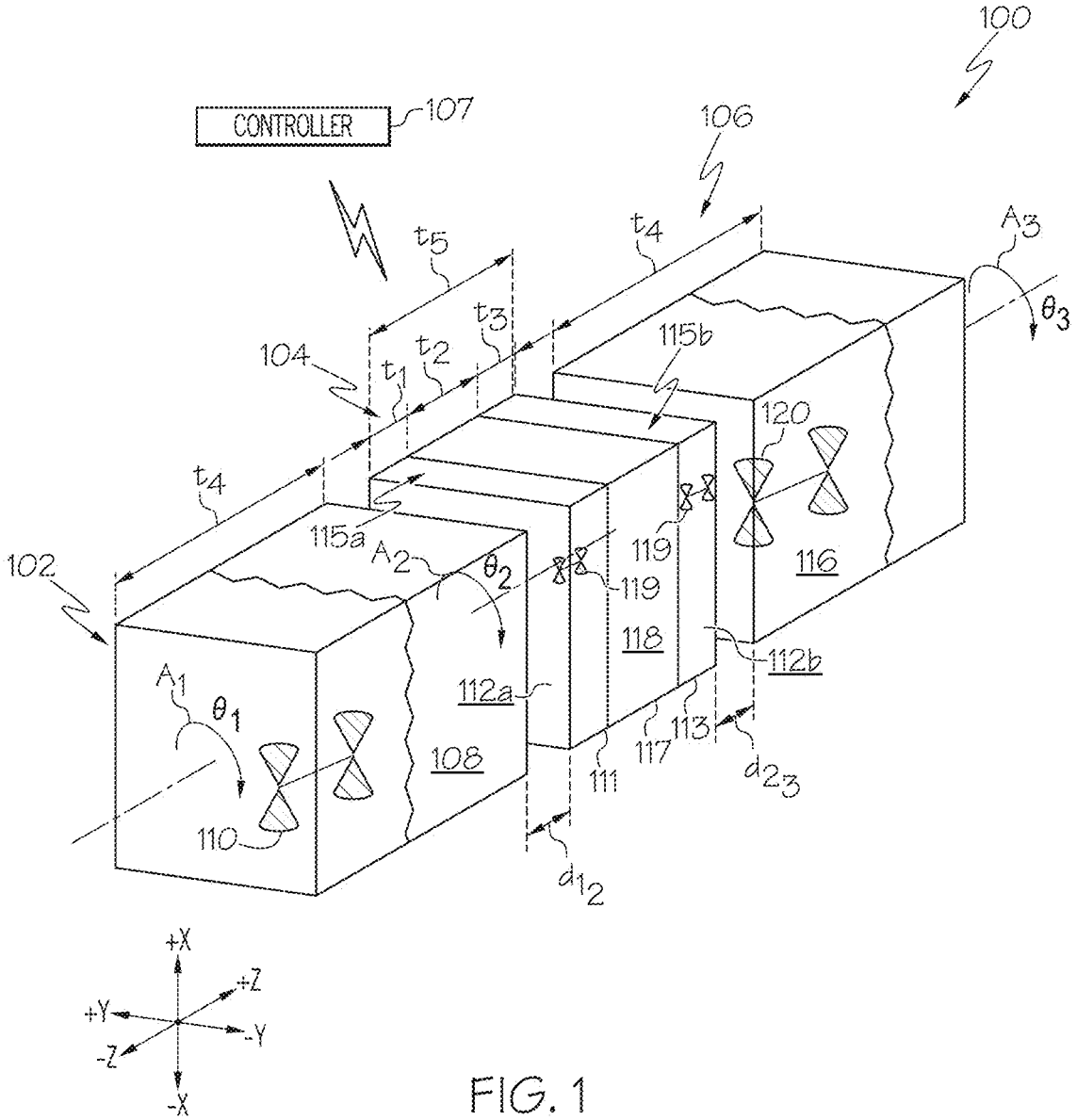
FIG. 1 schematically depicts a perspective view of an example thermal management system according to one or more embodiments shown and described herein.
Figure 4:
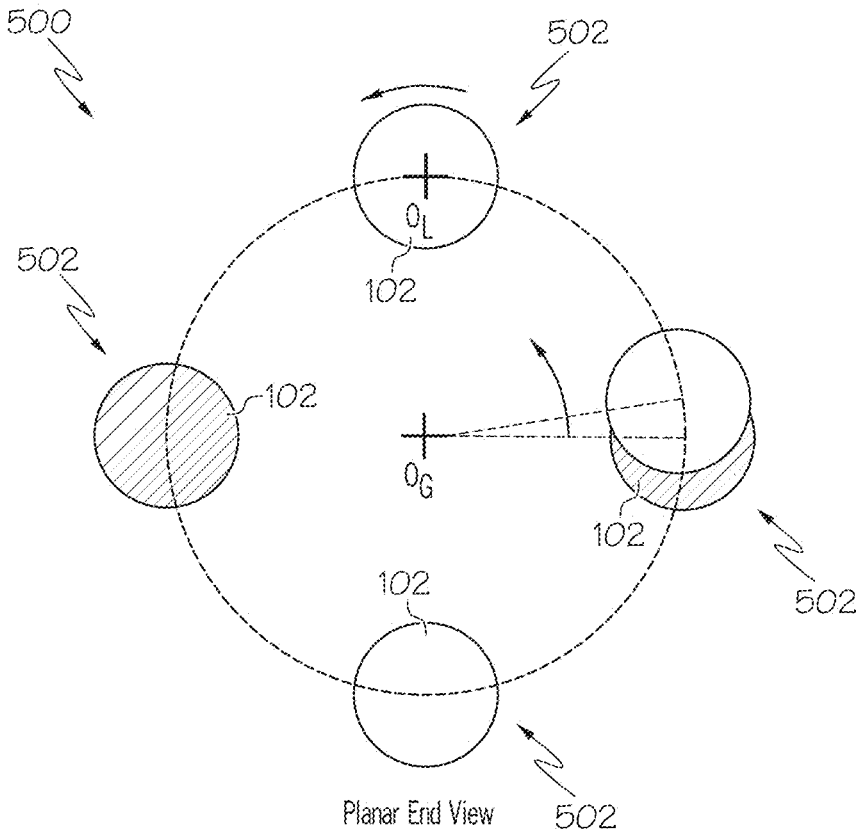
Figure 5B:
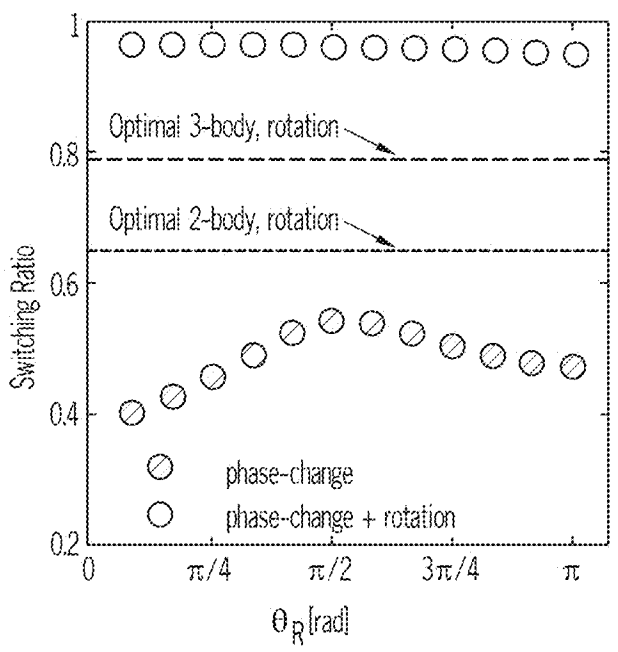
Figure 5A:
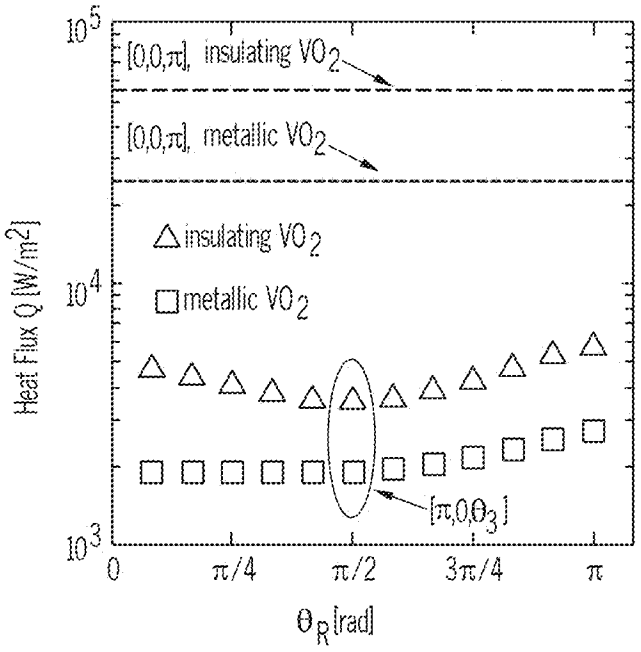
Figure 6:
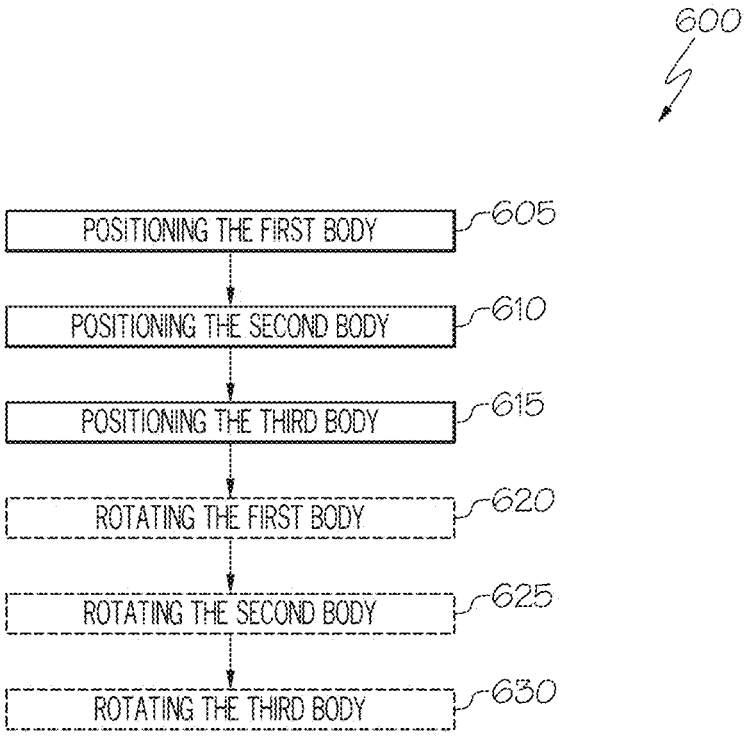

FIG. 4 schematically depicts an end planar view of an example application of the example thermal management system of FIG. 1 according to one or more embodiments shown and described herein;

FIG. 5A schematically depicts an example graph that illustrates a heat flux versus rotation where the first body and the second body are static and the third body of the thermal management system of FIG. 1 is rotated between 0 degrees and 180 degrees according to one or more embodiments shown and described herein;

FIG. 5B schematically depicts an example graph that illustrates a combined effect of a switching ratio of the thermal management system of FIG. 1 according to one or more embodiments shown and described herein; and FIG. 6 schematically depicts an illustrative method of forming the example thermal management system of FIG. 1 according to one or more embodiments shown and described herein.

DETAILED DESCRIPTION

Embodiments of the present disclosure are directed to thermal management systems that include a first body having a first plurality of Weyl semimetal nanostructures, a second body having a pair of Weyl semimetal layers sandwiching a phase change material layer, and a third body having a second plurality of Weyl semimetal nanostructures that form a three-body system. The second body is spaced apart from the first body and the third body is spaced apart from the second body. As such, the second body is positioned between the first and third bodies such that the first body, the second body and the third body are arranged in a linear arrangement along a same plane. Each of the bodies are configured to independently rotate about a common axis to change optical properties of the first plurality of Weyl semimetal nanostructures, the second plurality of Weyl semimetal nanostructures, and the pair of Weyl semimetal layers.

The rotation of any of the bodies' changes an optical property of the Weyl semimetal nanostructures to create a mismatch in a permittivity of the optical properties between the bodies such that an increase or decrease in a near-field radiative heat transfer may be achieved compared to a static state of the bodies.

The phase change material layer of the second body is configured to automatically transition, or switch, between a metallic phase and an insulating phase dependent on a temperature of the phase change material layer such that the second body is a heat modulator. When a heat received by the second body causes the temperature of the second body to be equal to or greater than a predetermined temperature, the second body automatically transitions to the metallic phase to reduce a heat transfer from the first body to the third body. When the heat received by the second body causes the temperature of the second body to be less than a predetermined temperature, the second body automatically transitions to the insulating phase to increase the heat transfer from the first body to the third body.

Various embodiments of optical metamaterials system to tune radiative management are described in detail herein.

As used herein, the term "communicatively coupled" means that coupled components are capable of exchanging data signals and/or electric signals with one another such as, for example, electrical signals via conductive medium, electromagnetic signals via air, optical signals via optical waveguides, electrical energy via conductive medium or a non-conductive medium, data signals wirelessly and/or via conductive medium or a non-conductive medium and the like.

Further, as used herein, the term "system lateral direction" refers to the forward-rearward direction of the system (i.e., in a +/−Y direction of the coordinate axes depicted in FIG. 1). The term "system longitudinal direction" refers to the cross-direction (i.e., along the X-axis of the coordinate axes depicted in FIG. 1), and is transverse to the lateral direction. The term "system vertical direction" refers to the upward-downward direction of the system (i.e., in the +/−Z direction of the coordinate axes depicted in FIG. 1).

Figure 2:
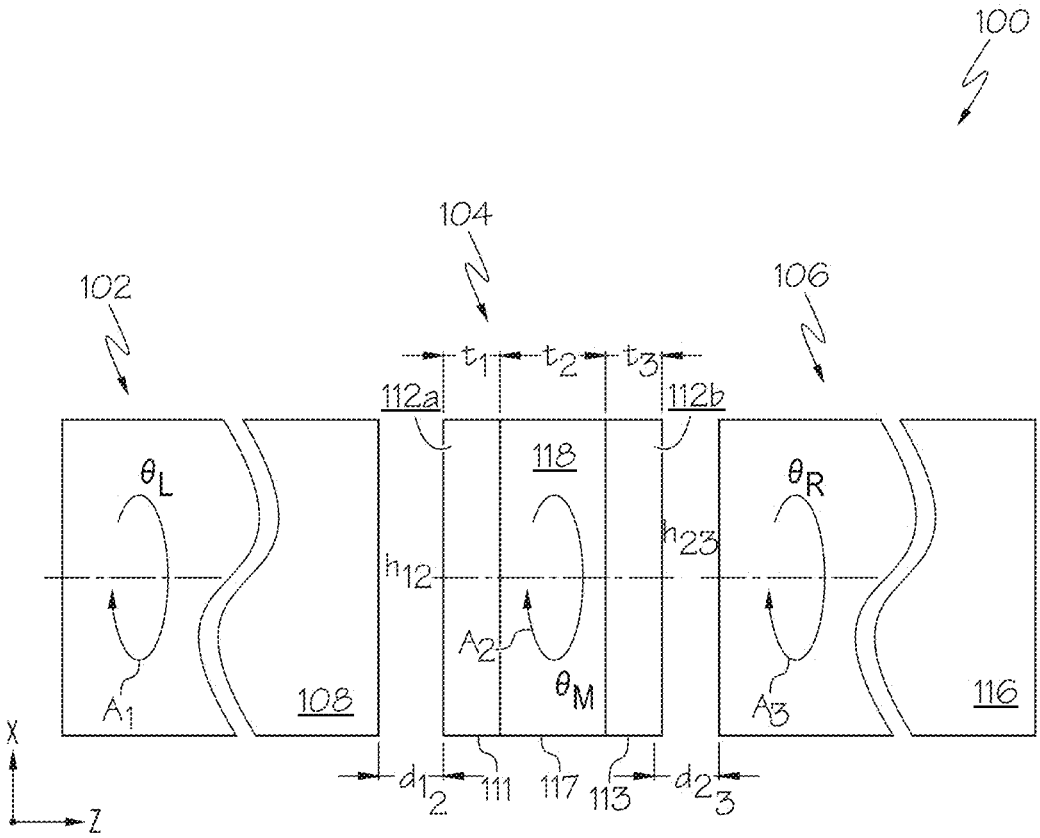
FIG. 2 schematically depicts side view of the thermal management system of FIG. 1 according to one or more embodiments shown and described herein.

Referring now to FIGS. 1-2, an example thermal management system 100 is schematically illustrated. The example thermal management system 100 may be a bi-functional thermal management system. The example thermal management system 100 may be a three-body management system that includes a first body 102, a second body 104 spaced apart from the first body 102, and a third body 106, spaced apart from the second body 104. The second body 104 may be positioned between the first body 102 and the third body 106. As such, the first body 102, the second body 104 and the third body 106 may be positioned in a linear arrangement along a same, or common, axis.

The first body 102 has an outer surface 108 that includes a first plurality of Weyl semimetal nanostructures 110. As used herein, "Weyl semimetal nanostructures" may be three-dimensional topological materials where valence band and conduction band touch at finite specific points in momentum space. The first plurality of Weyl semimetal nanostructures 110 may be any shape including, for example, bicone shaped, dicone shaped, cone shaped, frustoconical shaped, cylindrical shaped, tetragonal shaped, hexagonal shaped, and/or the like.

The second body 104 is formed by three layers, a first layer 111, a second layer 113 and a third layer 117. The first layer 111 and the second layer 113 may be formed with the same material and are positioned to sandwich the third layer 117. As such, the third layer 117 is positioned between the first layer 111 and the second layer 113. The first layer 111 includes an outer surface 112*a* and the second layer includes an outer surface 112*b*, which may be formed of identical material. For example, the outer surfaces 112*a*, 112*b* and/or portions of the first layer 111 and the second layer 113, respectively, may each be formed from and/or include a Weyl semimetal nanostructures film 115*a*, 115*b*, respectively. The Weyl semimetal nanostructures film 115*a*, 115*b* may include a plurality of Weyl semimetal nanostructures 119. Each of the Weyl semimetal nanostructures 119 may be any shape including, for example, bicone shaped, dicone shaped, cone shaped, frustoconical shaped, cylindrical shaped, tetragonal shaped, hexagonal shaped, and/or the like. The Weyl semimetal nanostructures 119 may be the same or different from those of the first plurality of Weyl semimetal nanostructures 110.

The third layer 117 may be formed with a vanadium dioxide ($VO_2$) film. That is, a phase change material 118 may be used within, on, and/or as the third layer 117 in the multilayer structure of the second body 104. Example $VO_2$ films that may be deposited directly between two Weyl semimetal layers, or on various substrate that are infrared transparent, include, but not limited to, silicon (Si), Barium Fluoride ($BaF_2$), Cadmium Telluride (CdTe), and Gallium Arsenide (GaAs), and the like. It should be understood that $VO_2$ undergoes a reversible phase transition from a low-temperature monoclinic $VO_2$(M1) semi-conductive phase or insulating phase to a high-temperature tetragonal $VO_2$(R) metallic phase at a transition temperature ($T_{tr}$). In some embodiments, the transition temperature ($T_{tr}$) is dependent on the material used for the emitter device, which may be the first body 102, as discussed in greater detail herein. For example, in some embodiments, the transition temperature ($T_{tr}$) of the first body 102 may be between 20 degrees Celsius to 70 degrees Celsius for the third layer 117 to remain in the low emissivity state (e.g., with the heat received by the second body 104 and dispersed to the third body 106) and a minimum temperature of 50 degrees Celsius for third layer 117 to transition into the metallic phase, inhibiting the second body 104 from receiving the heat from the first body 102 and reducing the dispersion of the heat to the third body 106. It should be appreciated that these are non-limiting examples of temperatures and/or temperature ranges and that these temperatures may change or vary based on various parameters, such as, without limitation, doping (e.g., with Tungsten), future material or substrate combinations.

As such, the second body 104 is a self-adaptive thermal switching system that uses a phase change material to transition the example thermal management system 100 between the insulating phase, where the optical properties permit or allow more heat transfer from the first body 102 to the third body 106 through the second body 104, and the metallic phase where the optical properties inhibit or significantly limit the amount of heat transferred from the first body 102 to the third body 106 through the second body 104. That is, the heat transfer from the first body 102 to the third body 106 through the second body 104 is regulated in a self-adaptive manner dependent on the temperature and thus the phase of the vanadium dioxide in the second body 104, which changes with the heat received from the first body 102.

In some embodiments, a thickness $t_1$ of the first layer 111 and a thickness $t_3$ of the second layer 113 may be equal, or otherwise symmetric. In this embodiment, a thickness $t_2$ of the third layer 117 may be greater than either the thickness $t_1$ of the first layer 111 and/or the thickness $t_3$ of the second layer 113. As such, in some embodiments, the thickness $t_2$ of the third layer 117 may be larger than the sum of the thickness $t_1$ of the first layer 111 and the thickness $t_3$ of the second layer 113. In a non-limiting example, the thickness $t_1$ of the first layer 111 and the thickness $t_3$ of the second layer 113 may each be 100 nm, while the thickness $t_2$ is 300 nm. In other embodiments, the thickness $t_1$ of the first layer 111 and the thickness $t_3$ of the second layer 113 may be different, unequal, or otherwise asymmetric. Further, in other embodiments, the thickness $t_2$ of the third layer 117 may be equal to, or less than either the thickness $t_1$ of the first layer 111 and/or the thickness $t_3$ of the second layer 113 and/or a sum of the thickness $t_1$ of the first layer 111 and the thickness $t_3$ of the second layer 113 may equal the thickness $t_3$ of the third layer 117.

The third body 106 has an outer surface 116 that includes a second plurality of Weyl semimetal nanostructures 120. The second plurality of Weyl semimetal nanostructures 120 may be any shape including, for example, bicone shaped, dicone shaped, cone shaped, frustoconical shaped, cylindrical shaped, tetragonal shaped, hexagonal shaped, and/or the like. The second plurality of Weyl semimetal nanostructures 120 may be the same as or different from those of the first plurality of Weyl semimetal nanostructures 110 and/or the Weyl semimetal nanostructures 119 of the first layer 111 and/or the second layer 113.

In some embodiments, the thickness of the first body 102 and the third body 106 are equal, as illustrated by $t_4$. The second body 104 has an overall thickness less than that of the first body 102 and the second body 104, as illustrated by $t_5$. In a non-limiting example, the thickness $t_4$ of the first body 102 and the third body 106 may each be 500 μm while the thickness $t_5$ of the second body 104 may be 200 nm. In other embodiments, the thickness $t_4$ of the first body 102 and the third body 106 may be different where either the thickness $t_4$ of the first body 102 is greater than the thickness $t_4$ of the third body 106 or the thickness $t_4$ of the third body 106 is greater than the thickness $t_4$ of the first body 102.

In some embodiments, the first body 102 may be a heat source to generate a heat, the second body 104 may be a heat modulator to receive/modulate the heat, and the third body 106 may be a heat sink. Further, in some embodiments, a controller 107, such as a microprocessor may be communicatively coupled to the first body 102, the second body 104, and/or the third body 106. It should be appreciated that more than one microprocessor may be communicatively coupled to the first body 102, the second body 104, and/or the third body 106 (e.g., one microprocessor for each body or one microprocessor that is shared between the second body 104 and the third body 106, and the like). The microprocessor of the controller 107 may be a computer processor where the data processing logic and control is included on a single integrated circuit, or a small number of integrated circuits and contains the arithmetic, logic, and control circuitry required to perform the functions of a computer's central processing unit.

Still referring to FIGS. 1-2, in some embodiments, the first body 102, the second body 104, and the third body 106 are oriented along the same axis, for example, the Z-axis. Further, the spaces or gaps between each of the first body 102, second body 104, and third body 106 may be a cavity, or a vacuum gap $d_{12}$ and $d_{23}$. That is, the cavity or vacuum gap $d_{12}$ may be positioned to separate the first body 102 from the second body 104. The cavity or vacuum gap $d_{23}$ may be positioned to separate the second body 104 from the third body 106. In some embodiments, the vacuum gap $d_{12}$ and $d_{23}$ may be uniform, symmetrical, or equally spaced apart. In other embodiments, the vacuum gap $d_{12}$ and $d_{23}$ may be different, uneven, or have an irregular space or distance.

That is, in some embodiments, the space between the first body 102 and the second body 104 defined by the vacuum gap $d_{12}$ may be equal to the space between the second body 104 and the third body 106 defined by the vacuum gap $d_{23}$. In a non-limiting example, the space of the vacuum gap $d_{12}$ and the space of the vacuum gap $d_{23}$ may each be 100 nm. In other embodiments, the space between the first body 102 and the second body 104 defined by the vacuum gap $d_{12}$ may be different than the space between the second body 104 and the third body 106 defined by the vacuum gap $d_{23}$. Further, in some embodiments, the space between the first body 102 and the second body 104 defined by the vacuum gap $d_{12}$ and the space between the second body 104 and the third body 106 defined by the vacuum gap $d_{23}$ may be less than the thickness $t_5$ of the second body 104. In other embodiments, the space between the first body 102 and the second body 104 defined by the vacuum gap $d_{12}$ and the space between the second body 104 and the third body 106 defined by the vacuum gap $d_{23}$ may be the same or equal to the thickness $t_5$ of the second body 104.

Still referring to FIGS. 1-2, in some embodiments, the thickness $t_1$ of the first layer 111 and the thickness $t_3$ of the second layer 113 of the second body 104 may be a finite plate made of Weyl semimetals. In some embodiments, the first body 102 and the third body 106 may each be semi-infinite plates with the first body 102 at temperature of $T-\Delta T_1$ and the third body 106 at temperature $T+\Delta T_2$, separated by the vacuum gaps $d_{12}$ and $d_{23}$ from the second body 104, which is at the temperature of T and has an overall thickness of $t_5$. The near-field thermal radiation between two Weyl semimetal plates may be modulated by applying a relative rotation, as discussed in greater detail herein. As such, as discussed in greater detail herein, the first body 102, the second body 104 and the third body 106 may freely and independently rotate away from the X-axis by angles of $\theta_1$, $\theta_2$ and $\theta_3$ ranging from 0 to $\pi$ as depicted by arrows A1, A2, A3, respectively, in FIG. 1. The controller 107 may be programmed to cause the first body 102, the second body 104 and the third body 106 to freely and independently rotate away from the X-axis by angles of $\theta_1$, $\theta_2$ and $\theta_3$ ranging from 0 to $\pi$.

That is, the first body 102, the second body 104 and the third body 106 are each configured to independently rotate along the Z-axis, depicted in FIG. 1. As such, each of the first body 102, the second body 104 and the third body 106 rotate with respect to another. As discussed in greater detail herein, the rotation of the first body 102, the second body 104, and/or the third body 106 changes an optical property of the first plurality of Weyl semimetal nanostructures 110 of the first body 102, an optical property of the second plurality of Weyl semimetal nanostructures 120 of the third body 106 and the Weyl semimetal nanostructures 119 of the first layer 111 and the second layer 113 of the second body 104. The changes in the optical properties of the first body 102, the second body 104 and/or the third body 106 may create a mismatch in a permittivity of the optical properties each of the first body 102, the second body 104 and the third body 106 compared to the optical properties of the first body 102, the second body 104, and/or the third body 106 in an unrotated state, as discussed in greater detail herein.

Further, the rotation of the first body 102, the second body 104 and/or the third body 106 increases or decreases a near-field radiative heat transfer compared to a static state of the first body 102, the second body 104 and/or the third body 106, as discussed in greater detail herein. Further, the position of the first body 102, the second body 104, and the third body 106 may be changed. As such, changing the position and/or rotation of the first body 102, the second body 104, and the third body 106, such that the first body 102, the second body 104, and the third body 106 switch between a symmetric arrangement and an asymmetric arrangement change the near-field radiative heat transfer to either increase or decrease the near-field radiative heat transfer, as discussed in greater detail herein. That is, the first body 102, the second body 104 and/or the third body 106 may be either rotated, the positioned changed, and/or a combination of both rotation and changing the position to switch between the symmetric arrangement and the asymmetric arrangement to change the near-field radiative heat transfer to either increase or decrease the near-field radiative heat transfer.

In other embodiments, the first body 102, the second body 104, and/or the third body 106, while illustrated as plates and square or rectangular, is non-limiting and the first body 102, the second body 104, and/or the third body 106 may be any shape, such as an octagon, circular, hexagonal, spherical, elliptical, and the like.

Still referring to FIGS. 1-2, the near-field thermal radiation between the first body 102 and the second body 104 may be modulated by applying a relative rotation. Incident electromagnetic waves may be parallel to the xz-plane with incident angles $\phi$ from the X-axis. As such, when the second body 104 and the third body 106 each host Weyl nodes with a wavevector separation of $2\vec{b}$, where $\vec{b}=b\hat{y}$, the permittivity tensor is defined by Equation 1 below:

$$\bar{\bar{\epsilon}}(\phi+\theta_m)=\begin{bmatrix}\epsilon_d & 0 & i\epsilon_a\cos(\phi+\theta_m)\\ 0 & \epsilon_d & i\epsilon_a\sin(\phi+\theta_m)\\ -i\epsilon_a\cos(\phi+\theta_m) & -i\epsilon_a\sin(\phi+\theta_m) & \epsilon_d\end{bmatrix} \quad (1)$$

where m=2, 3 correspond to the second body 104 or the third body 106, and $$\epsilon_a=\frac{be^2}{2\pi^2\hbar\omega}.$$

Therefore, $\bar{\bar{\epsilon}}$ is asymmetric and breaks Lorentz reciprocity. The diagonal component $\epsilon_d$ is calculated by using the Kubo-Greenwood formalism within the random phase approximation to a two-band model with spin degeneracy, defined by Equation 2 below:

$$\epsilon_d=\epsilon_b+\frac{ir_sg}{6\Omega_0}\Omega G\left(\frac{\Omega}{2}\right)-\frac{r_sg}{6\pi\Omega_0}\left\{\frac{4}{\Omega}\left[1+\frac{\pi^2}{3}\left(\frac{k_BT}{E_F(T)}\right)^2\right]+8\Omega\int_0^{\eta_c}\frac{G(\eta)-G\left(\frac{\Omega}{2}\right)}{\Omega^2-4\eta^2}\eta d\eta\right\} \quad (2)$$

In Equation 2, $\epsilon_b$ is the background permittivity, $E_F$ is the chemical potential with the temperature dependence captured by Equation 3 below:

$$E_F(T)=\frac{2^{\frac{1}{3}}\left[9E_F(0)^3+\sqrt{81E_F(0)^6+12\pi^6k_B^6T^6}\right]-2\pi^2 3^{\frac{1}{3}}k_B^2T^2}{6^{\frac{2}{3}}\left[9E_F(0)^3+\sqrt{81E_F(0)^6+12\pi^6k_B^6T^6}\right]^{\frac{1}{3}}} \quad (3)$$

where $E_F(0)=0.163$ eV is the chemical potential at T=0 K such that $E_F=0.15$ eV at T=300 K, $$\Omega_0=\frac{\hbar\omega}{E_F}$$

is the normalized real frequency, $$\Omega=\frac{\hbar(\omega+i\tau^{-1})}{E_F}$$

is the normalized complex frequency, $\tau^{-1}$ is the Drude damping rate, G(E)=n(−E)−n(E), with n(E) being the Fermi distribution function $$r_s=\frac{e^2}{4\pi\epsilon_0\hbar v_F}$$

is the effective fine-structure constant, $v_F$ is the Fermi velocity, g is the number of Weyl nodes, and $$\eta_c = \frac{E_c}{E_F},$$

where $E_c$ is the cutoff energy beyond which the band dispersion is no longer linear. As such, for calculation and/or simulation purposes the flowing parameters are used: $\epsilon_b=6.2$, $\eta_c=3$, $\tau=1\times10^{-12}$ s, g=2, $b=2\times10^9$ $m^{-1}$, and $v_F=0.83\times10^5$ m/s.

For the example thermal management system 100, the total heat flux $Q_{tot}$ from the first body 102, the second body 104, and the third body 106 may be evaluated as the summation of the heat fluxes from the first body 102 to the second body 104, $Q_{12}$, and the second body 104 to the third body 106, $Q_{13}$, respectively. The expression is given by the fluctuational electrodynamics defined by Equation 4:

$$Q_{tot}(\theta_1, \theta_2, \theta_3) = Q_{12}(\theta_1, \theta_2, \theta_3) + Q_{13}(\theta_1, \theta_2, \theta_3) \tag{4}$$
$$= \int_{-\infty}^{\infty} \frac{d\beta}{2\pi}|\beta| \int_0^{+\infty} \frac{d\omega}{2\pi} \int_0^{\pi} \frac{d\phi}{2\pi} \left[\Theta_{12}(\omega, T, \Delta T_1)\xi^{1,2}(\omega, \beta, \phi, \theta_1, \theta_2, \theta_3) + \Theta_{13}(\omega, T, \Delta T_1, \Delta T_3)\xi^{1,3}(\omega, \beta, \phi, \theta_1, \theta_2, \theta_3)\right]$$

where s and p represent the polarization of the incident electromagnetic wave, β is the wave vector component that is parallel to the xy-plane, ω is the angular frequency, $\Theta_{12}(\omega, T, \Delta T_1)=\Theta_1(\omega, T-\Delta T_1)-\Theta_2(\omega, T)$ and $\Theta_{13}(\omega, T, \Delta T_1, \Delta T_2)=\Theta_1(\omega, T-\Delta T_1)-\Theta_3(\omega, T+\Delta T_3)$ represent the difference between the mean energy of Planck's oscillators for each body $$\Theta_1(\omega, T-\Delta T_1) = \hbar\omega/\left\{\exp\left[\frac{\hbar\omega}{k_B(T-\Delta T_1)}\right]-1\right\}, \Theta_2(\omega, T) = \hbar\omega/\left\{\exp\left[\frac{\hbar\omega}{k_B T}\right]-1\right\} \text{ and } \Theta_3(\omega, T+\Delta T_3) = \hbar\omega/\left\{\exp\left[\frac{\hbar\omega}{k_B(T-\Delta T_3)}\right]-1\right\},$$

and $\xi^{1,2}(\omega, \beta, \phi, \theta_1, \theta_2, \theta_3)$ [ ] is the photon tunneling probability from the first body 102 to the second body 104 and $\xi^{1,3}(\omega, \beta, \phi, \theta_1, \theta_2, \theta_3)$ is the photon tunneling probability from the first body 102 to the third body 106 through the second body 104, both of which are determined by the rotation angles $\theta_1$, $\theta_2$, and $\theta_3$ for the incident angle ϕ. These probabilities may be obtained by a scattering matrix defined by Equations 5 and 6 below:

$$\xi^{1,2}(\omega, \beta, \phi, \theta_2) = Tr\{\mathbb{D}_{1,23}\mathbb{W}_{-1}(\mathbb{S}_1)\mathbb{D}_{1,23}^{\dagger}[\mathbb{W}_1(\mathbb{S}_{32-}) - \mathbb{T}_{2-}\mathbb{D}_{3,2}\mathbb{W}_1(\mathbb{S}_3)\mathbb{D}_{3,2}^{\dagger}\mathbb{T}_{2-}^{\dagger}]\} \tag{5}$$

$$\xi^{1,3}(\omega, \beta, \phi, \theta_3) = Tr\{\mathbb{D}_{12,3}\mathbb{T}_{2+}\mathbb{D}_{1,2}\mathbb{W}_{-1}(\mathbb{S}_1)\mathbb{D}_{1,2}^{\dagger}\mathbb{T}_{2+}^{\dagger}\mathbb{D}_{12,3}^{\dagger}\mathbb{W}_1(\mathbb{S}_3)\} \tag{6}$$

where Tr{ . . . } denotes the matrix trace, and the auxiliary functions are defined by Equation 7 below:

$$\mathbb{W}_n(\mathbb{S}_i) = \begin{cases} \sum_{-1}^{pw} - \mathbb{S}_i \sum_{-1}^{pw} \mathbb{S}_i^{\dagger} + \mathbb{S}_i \sum_{-1}^{ew} - \sum_{-1}^{ew} \mathbb{S}_i^{\dagger}, & n=-1 \\ \sum_{1}^{pw} - \mathbb{S}_i^{\dagger} \sum_{1}^{pw} \mathbb{S}_i + \mathbb{S}_i^{\dagger} \sum_{1}^{ew} - \sum_{1}^{ew} \mathbb{S}_i, & n=1 \end{cases} \tag{7}$$

where $\mathbb{S}_1 = e^{ik_{oz}d_{12}}\mathbb{R}_1 e^{ik_{oz}d_{12}}$, $\mathbb{S}_{2\pm} = \mathbb{R}_{2\pm}$, and $\mathbb{S}_3 = e^{ik_{oz}d_{23}}\mathbb{R}_3 e^{ik_{oz}d_{23}}$ are scattering operators associated to the first body 102, the second body 104, and the third body 106 based on the reflection matrices $\mathbb{R}_1$, $\mathbb{R}_{2\pm}$, and $\mathbb{R}_3$, which correspond to the interfaces between the first body 102 and vacuum gap $d_{12}$, the first body 102 and the second body 104, the second body 104 and the second vacuum gap $d_{23}$, and the first body 102 to the third body 106.

The "+" and "−" symbols represent the directions pointing towards the positive and negative z-axis, respectively. $\mathbb{S}_{12+}$ and $\mathbb{S}_{23}$ are the scattering operators when treating the first and second bodies and the second and third bodies as an individual or a single body. The two reflection matrices under such treatment follow the expressions, $\mathbb{R}_{12+} = \mathbb{R}_{2+} + \mathbb{T}_{2+}\mathbb{D}_{1,2}e^{ik_{oz}d_{12}}\mathbb{R}_1 e^{ik_{oz}d_{12}}\mathbb{D}_{1,2}^{\dagger}\mathbb{T}_{2+}^{\dagger}$ and $\mathbb{R}_{23-} = \mathbb{R}_{2-} + \mathbb{T}_{2-}\mathbb{D}_{2,3}e^{ik_{oz}d_{23}}\mathbb{R}_3 e^{ik_{oz}d_{23}}\mathbb{D}_{2,3}^{\dagger}\mathbb{T}_{2-}^{\dagger}$, where $\mathbb{D}_{1,2} = (\mathbb{I} - \mathbb{S}_1\mathbb{S}_{2-})^{-1}$ and $\mathbb{D}_{2,3} = (\mathbb{I} - \mathbb{S}_{2+}\mathbb{R}_3)^{-1}$ are Fabry-Pérot-type matrices. Similarly, $\mathbb{D}_{1,23} = (\mathbb{I} - \mathbb{S}_1\mathbb{S}_{23-})^{-1}$ and $\mathbb{D}_{12,3} = (\mathbb{I} - \mathbb{S}_{12+}\mathbb{S}_3)^{-1}$.

Still referring to FIGS. 1-2, the reflection and transmission matrices used above in Equations 5-6, are derived by solving the Maxwell's equation in the following compact form, $$\partial\psi(z)/\partial z = \mathbb{K}\psi(z) \tag{8}$$

where $\psi(z)=(\varepsilon_x, \varepsilon_y, \mathcal{H}_x, \mathcal{H}_y)$ contains tangential electric and magnetic fields and $\mathbb{K}$ is a 4×4 eigenmatrix. The eigenvalues and eigenvectors can be determined using linear algebra. Then the reflection and transmission coefficients at each interface in the system in FIG. 1 can be calculated by transfer matrix method.

Still referring to FIGS. 1-2, in Equation 7 above, the projection operators $$\sum_{1(-1)}^{pw(ew)}$$

are used to identify the propagating and evanescent modes. Denoting $\mathbb{R}_{i\alpha}$ ($\mathbb{T}_{i\alpha}$) as the reflection (transmission) matrix at the interface between the body i and the vacuum cavity, where α indicates "+" or "−", the matrix may be determined by solving the Maxwell's equation by matching the boundary conditions at the corresponding interfaces. These matrices take the form $$\mathbb{R}_{i\alpha} = \begin{pmatrix} r_i^{pp} & r_i^{ps} \\ r_i^{sp} & r_i^{ss} \end{pmatrix} \text{ and } \mathbb{T}_{i\alpha} = \begin{pmatrix} t_i^{pp} & t_i^{ps} \\ t_i^{sp} & t_i^{ss} \end{pmatrix},$$

where the reflection coefficients and transmission coefficients account for s and p polarizations.

Referring back to FIG. 1 and Equation 4 above, the net heat flux flowing into the second body 104 is defined by $Q_{12}$. Similarly, the net heat flux flowing out of the second body 104 $Q_{23}$, which quantizes the net energy exchange between the second body 104 and the third body 106, may be defined. With these quantities, the temperature T of the second body 104 may be uniquely determined by enforcing the thermal equilibrium, $Q_{12}=Q_{23}$, and solving for T using an iterative process. To isolate the effect of the rotations of the first body 102, the second body 104 and the third body 106, it is convenient to introduce the following heat transfer coefficient $$h_{12}(\theta_1, \theta_2, \theta_3, T) - \lim_{\Delta T_1 \to 0} \left| \frac{Q_{12}(\theta_1, \theta_2, \theta_3)}{\Delta T_1} \right| \tag{9}$$

$$h_{23}(\theta_1, \theta_2, \theta_3, T) - \lim_{\Delta T_2 \to 0} \left| \frac{Q_{23}(\theta_1, \theta_2, \theta_3)}{\Delta T_2} \right| \tag{10}$$

$$h_{13}(\theta_1, \theta_2, \theta_3, T) - \lim_{\Delta T_1 \to 0, \Delta T_2 \to 0} \left| \frac{Q_{13}(\theta_1, \theta_2, \theta_3)}{\Delta T_1 + \Delta T_2} \right| \tag{11}$$

It should be understood that when assuming $\Delta T_1 \to 0$ and $\Delta T_2 \to 0$, the thermal equilibrium is automatically satisfied. As such, but the first body 102, the second body 104 and the third body 106 are rotated by angles $\theta_1$, $\theta_2$, $\theta_3$, respectively, ranging from 0 to $\pi$, the heat transfer coefficient $h_{12}$ corresponds to the vacuum gap $d_{12}$ and the heat transfer coefficient $h_{23}$ corresponds to the vacuum gap $d_{23}$.

Figure 3B:
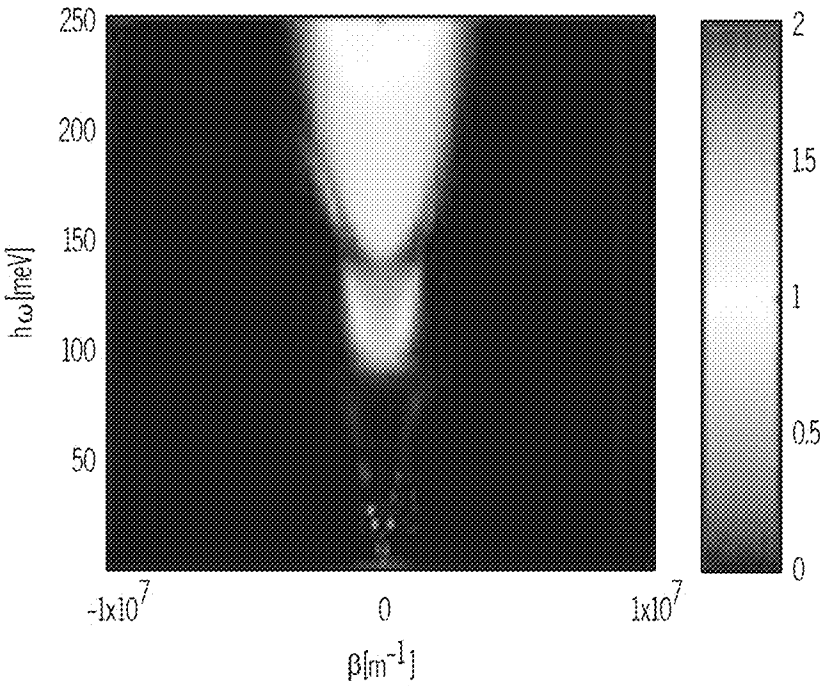
FIG. 3B schematically depicts a color map of an energy transmission coefficient between a second body and a third body of the thermal management system of FIG. 1 when the vanadium dioxide in the second body is in the insulating phase according to one or more embodiments shown and described herein.
Figure 3A:
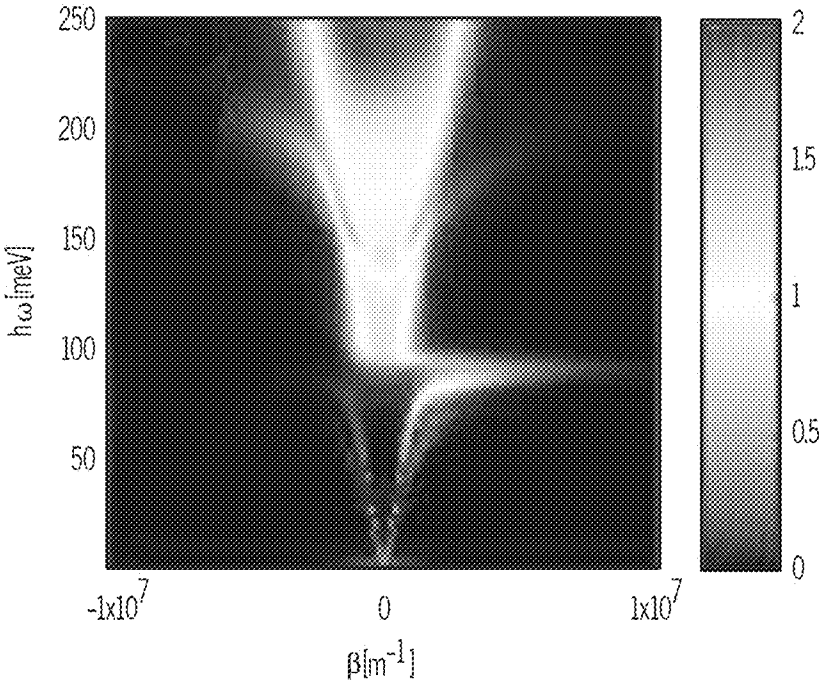
FIG. 3A schematically depicts a color map of an energy transmission coefficient that includes all three bodies of the thermal management system of FIG. 1 when a vanadium dioxide in a second body is in an insulating phase according to one or more embodiments shown and described herein.
Figure 3D:
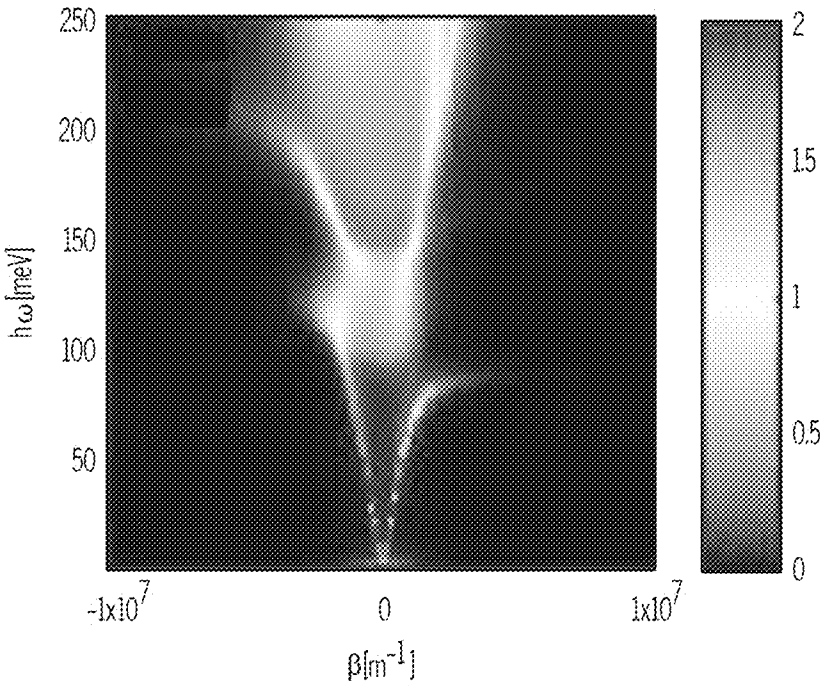
FIG. 3D schematically depicts a color map of an energy transmission coefficient that includes all three bodies of the thermal management system of FIG. 1 when the vanadium dioxide in the second body is in a metallic phase according to one or more embodiments shown and described herein.
Figure 3C:
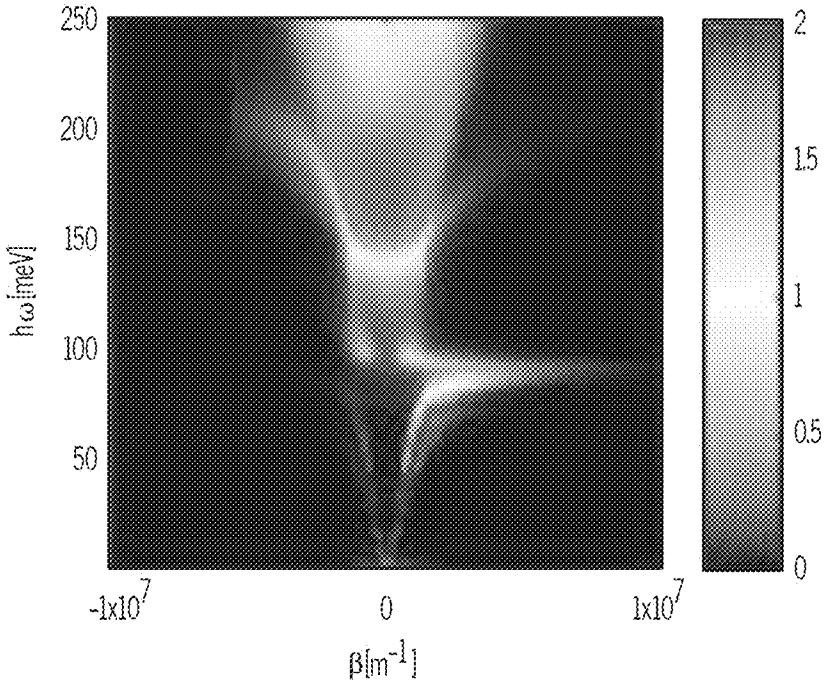
FIG. 3C schematically depicts a color map of an energy transmission coefficient between the first body and the second body of the thermal management system of FIG. 1 when the vanadium dioxide in the second body is in the insulating phase according to one or more embodiments shown and described herein.
Figure 3F:
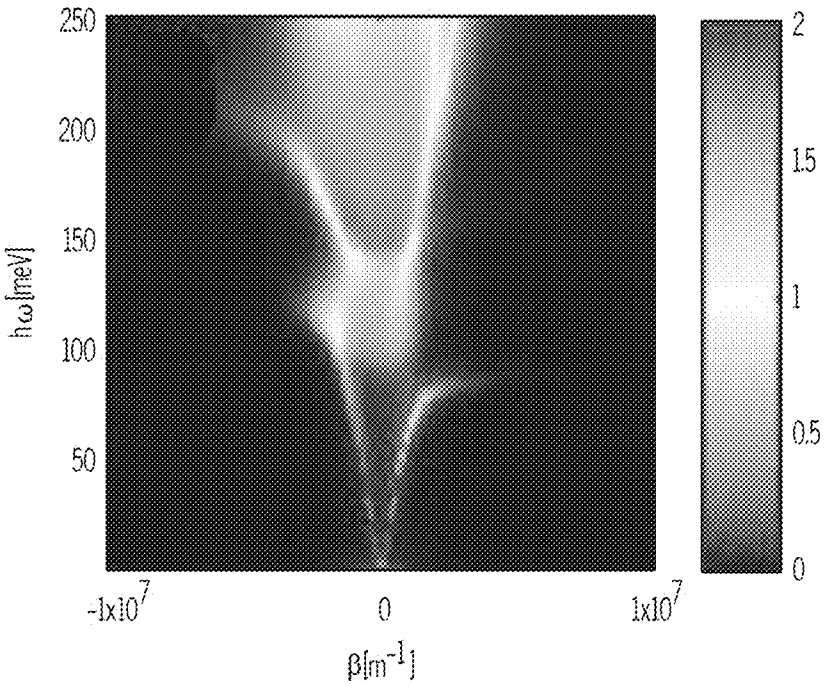
FIG. 3F schematically depicts a color map of an energy transmission coefficient between the first body and the second body of the thermal management system of FIG. 1 when the vanadium dioxide in the second body is in the metallic phase according to one or more embodiments shown and described herein.
Figure 3E:
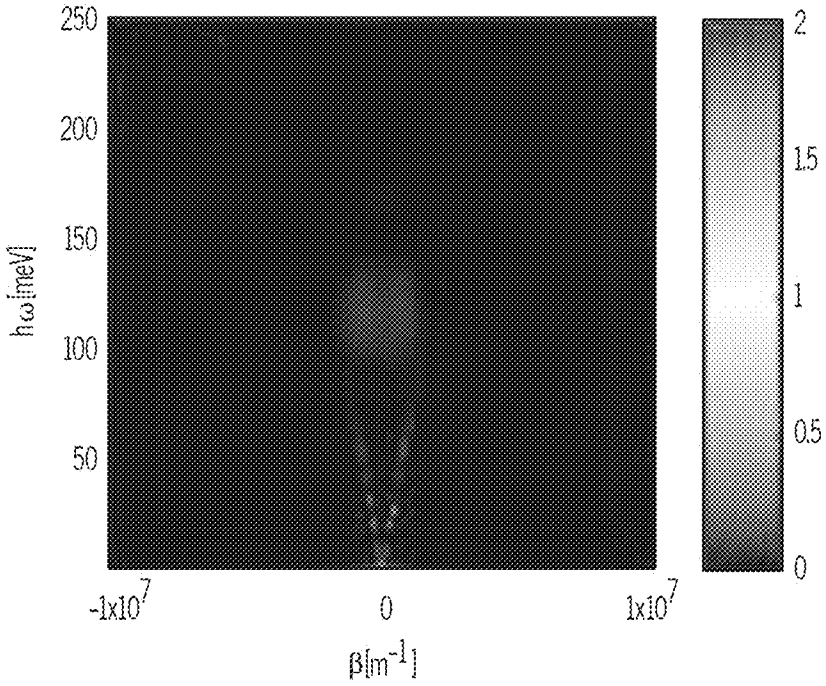
FIG. 3E schematically depicts a color map of an energy transmission coefficient between the second body and the third body of the thermal management system of FIG. 1 when the vanadium dioxide in the second body is in the metallic phase in the insulating phase according to one or more embodiments shown and described herein.

Now referring to FIGS. 2 and 3A-3F, the energy transmission coefficients between the various bodies are illustrated in the color map of FIGS. 3A-3F at different combinations of the various bodies of the example thermal management system 100 during the insulating phase, as best illustrated in FIGS. 3A-3C, and the metallic phase, as best illustrated in FIGS. 3D-3F.

FIG. 3A schematically depicts the color map of energy transmission coefficient that includes all three bodies (e.g., the first body 102, the second body 104, and the third body 106) in the insulating phase. As depicted, there is a greater amount of energy transfer from the first body 102 to the third body 106 through the second body 104 while in the insulating phase compared to the energy transfer when the phase change material 118 of the third layer 117 of the second body 104 is in the metallic phase, as depicted in FIG. 3D.

FIG. 3B schematically depicts the color map of energy transmission coefficient between the second body 104 and the third body 106 in the insulating phase. As depicted, there is a greater amount of energy transfer from the second body 104 to the third body 106 while the second body 104 is in the insulating phase compared to the energy transfer when the phase change material 118 of the third layer 117 of the second body 104 is in the metallic phase, as depicted in FIG. 3E.

FIG. 3C schematically depicts the color map of energy transmission coefficient between the first body 102 and the second body 104 in the insulating phase. As depicted, there is a greater amount of energy transfer from the first body 102 to the second body 104 while the second body 104 is in the insulating phase compared to the energy transfer when the phase change material 118 of the third layer 117 of the second body 104 is in the metallic phase, as depicted in FIG. 3F.

FIG. 3D schematically depicts the color map of energy transmission coefficient that includes all three bodies (e.g., the first body 102, the second body 104, and the third body 106) in the metallic phase. As depicted, there is a significantly less amount of energy transfer from the first body 102 to the third body 106 through the second body 104 while in the metallic phase compared to the energy transfer when the phase change material 118 of the third layer 117 of the second body 104 is in the insulating phase, as depicted in FIG. 3A.

FIG. 3E schematically depicts the color map of energy transmission coefficient between the second body 104 and the third body 106 in the metallic phase. As depicted, there is a significantly less amount of energy transfer from the second body 104 to the third body 106 while the second body 104 is in the metallic phase compared to the energy transfer when the phase change material 118 of the third layer 117 of the second body 104 is in the insulating phase, as depicted in FIG. 3B.

FIG. 3F schematically depicts the color map of energy transmission coefficient between the first body 102 and the second body 104 in the metallic phase. As depicted, there is a significant less amount of energy transfer from the first body 102 to the second body 104 while the second body 104 is in the metallic phase compared to the energy transfer when the phase change material 118 of the third layer 117 of the second body 104 is in the insulating phase, as depicted in FIG. 3C.

This demonstrates the self-adaptive functionality of either reducing or increasing the heat transfer based on a temperature of the third layer 117 of the second body 104, which is an improvement over conventional systems where the heat transfer may only be change by rotation of the bodies. Further, it should be appreciated that the heat transfer coefficients h (e.g., $h_{12}$, $h_{13}$, and $h_{23}$ defined in Equations 9-11) as a function of rotation angles $\theta_1$, $\theta_2$, and $\theta_3$ account for cavity size asymmetries. That is, the first body 102, the second body 104, the third body 106, the vacuum gap $d_{12}$ and/or the vacuum gap $d_{23}$ may be in an asymmetric arrangement. As such, an asymmetric arrangement of the first body 102, the second body 104, and the third body 106 increases or decreases a near-field radiative heat transfer compared to a symmetric arrangement.

Now referring to FIG. 4, an example heat flow control system 500 utilizing the example thermal management system 100 is schematically depicted from a planar end view. The example heat flow control system 500 includes a plurality of heat flow controls 502. Each of the plurality of heat flow controls 502 includes the example thermal management system 100 depicted in FIGS. 1-2. That is, each of the plurality of heat flow controls 502 includes the first body 102, the second body 104 and the third body 106, as described above. Each of the plurality of heat flow controls 502 may be described as a channel and each may be configured to have independent temperatures such that the switching of transitioning between the insulating phase and the metallic phase is independent from the other plurality of heat flow controls 502. As such, the heat transfer may be controlled in different situations. As such, in the depicted embodiment, there are four channels, in which each of the four channels may modulate heat at four different temperatures. This is non-limiting and there may be more or less than four channels.

That is, in this embodiment, each of the plurality of heat flow controls 502 may be independently rotated to change optical properties and each first body 102 of each of the plurality of heat flow controls 502 may be at a different temperature as the heat source. As such, each of the plurality of heat flow controls 502 form a local modulator set to control the heat flow transporting in that channel. Therefore, it is conceivable that at some instance in time, some of the plurality of heat flow controls 502 may be in the insulating phase while other one of the plurality of heat flow controls 502 may be in the metallic phase. As such, each channel is independent from one another and may transition between the insulating phase and the metallic phase, and vice versa, independently based on the temperature of that channel. Further, while the first body 102 described above is the heat source of the channel, an emitter may be positioned to in the example heat flow control system 500 to direct heat to each of the first body 102 of each of the plurality of heat flow controls 502. In some embodiments, the emitter may be centrally located to disperse an even amount of heat between each of the plurality of heat flow controls 502. In other embodiments, the emitter may be offset to disperse a different amount of heat to each of the plurality of heat flow controls 502.

Further, each of the plurality of heat flow controls 502 may independently rotate about a local origin, depicted as $O_L$. Further, the heat flow control system 500 may globally rotate about the global origin, depicted as $O_G$. The rotations within each modulator set controls the local thermal energy, while when the entire heat flow control system 500 rotates, the heat flow control system 500 controls thermal energy in multiple channels (e.g., four channels in the current drawing). In addition, since the thermal radiation depends on the view factors, when the global rotation occur, each of the units in each local modulator (e.g., each of the plurality of heat flow controls 502) do not overlap, which further modifies the thermal energy. As discussed, the number of the plurality of heat flow controls 502 can be increased or decreased depending on the application and the distance between the center of each local modulator set to the center of the global origin can be different, depending on the location of the heat channel in the application.

Now referring to FIGS. 5A-5B and back to FIG. 2, where FIG. 5A is an example graph that illustrates a heat flux versus rotation where the first body 102 and the second body 104 are static (e.g., $\theta_1=0$ and $\theta_2=0$), but the third body 106 is rotated to $\pi$ (or 180 degrees) about A3. As illustrated, the heat fluxes for the insulating phase, depicted as a longer dash line, and the metallic phase, depicted as the dotted line, illustrates that when the third body 106 is rotated to 180 degrees (or $\pi$ rad) and when the second body 104 is in the metallic phase, there is a significant reduction in the heat flux.

Further, when the first body 102 is rotated 180 degrees (or $\pi$ rad), the second body 104 is static (e.g., $\theta_2=0$) and the third body 106 is rotated between 0 and 180 degrees, there is a much smaller amount of heat transfer compared to the example above with the dash and dotted lines. That is, in this example, in the insulating phase, depicted as a triangle and in the metallic phase, depict as a square, along with rotation described in this example, there is much less amount of heat transfer than that compared to above where only the third body 106 is rotated. As such, by changing the rotation angles, different phase of the phase change material 118 of the third layer 117 of the second body 104 may have varying heat modulating characteristics.

FIG. 5B illustrates the combined effect of the switching ratio defined as $$\frac{Q_i - Q_f}{Q_i},$$

where $Q_i$ and $Q_f$ denote the heat fluxes of the initial and final states of the switching. The depicted dashed line is the switching ratio with only rotation of the three bodies (e.g., the first body 102, the second body 104, and the third body 106) and the depicted dotted line is the rotation of only two bodies (e.g., a system that only has two bodies instead of three bodies as depicted in FIG. 1; this 2-body system has a first body 102 and a third body 106, but misses a second body 104 as a modulator). The combined effect of the switching ratio that includes the phase change material (e.g., the phase change material 118 of the third layer 117 of the second body 104) without rotation, is depicted as a shaded circle. Here, the switching may be from the insulating (triangle markers) to the metallic (square markers) of FIG. 5A. In this example, the rotation angles are unchanged and the thermal switching is only caused by the phase change of $VO_2$ (e.g., the phase change material 118) of the third layer 117 of the second body 104. The corresponding maximized switching ratio (54.2%) is achieved when the third body 106 is rotated to 90 degrees (or $\pi/2$ rad).

The switching ratio that includes both the phase change material (e.g., the third layer 118 of the second body 104) and the rotation is depicted as the empty circle. This switching ratio is obtained by switching from the insulating phase with $\theta_1=0$, $\theta_2=0$, and $\theta_3=\pi$ (i.e., the dashed line in FIG. 5A) to the metallic phase with $\theta_1=1$, $\theta_2=0$, and $\theta_3$ varying between 0 to $\pi$ (i.e., squared markers). Because $Q_i$ is much larger, the switching ratio increases substantially, with its maximum reaching 96.6%. Comparing the empty-circles and the shaded circles, the maximized switching ratio is improved by 42.4%. This demonstrates the advantage of combining the phase-change capabilities and the rotation of bodies to realize much better thermal switching performance. That is, the combined effect of the switching ratio is at its highest when including the phase change material (e.g., the phase change material 118 of the third layer 117 of the second body 104) with rotation. As such, it is advantageous to combine both effects to have the highest switching ratio capabilities.

With the switching ratio optimized, it is possible to have precise temperature control when the third body 106 is a delicate temperature driven component or when the third body 106 must be maintained above a predetermined temperature, at the predetermined temperature, or less than the predetermined temperature such that only the optimal amount of heat is transferred to the third body 106 such that the third body 106 may operate at its most optimal temperature. Such application may be found in the thermal management of battery packs in electric vehicles.

FIG. 6 is a flow diagram that graphically depicts an illustrative method 600 forming the bi-functional thermal management system. Although the steps associated with the blocks of FIG. 6 will be described as being separate tasks, in other embodiments, the blocks may be combined or omitted. Further, while the steps associated with the blocks of FIG. 6 will be described as being performed in a particular order, in other embodiments, the steps may be performed in a different order.

At block 605, the first body is positioned. The first body may be positioned along a common axis. The first body may be formed from and/or include a plurality of Weyl semimetal nanostructures, each having an optical property that controls the radiative heat transfer. The first body may be rotatable about a rotation angle $\theta_1$ between 0 to $\pi$ (or 180 degrees) to change the optical property of each of the first plurality of Weyl semimetal nanostructures of the first body such that a mismatch in a permittivity of the optical properties between the first body and the other two bodies in the example thermal management system is generated. At block 610, the second body is positioned to be spaced apart from the first body. The second body may be positioned a distance away from the first body and may be positioned along the common axis. The second body may be formed from three layers, in which the two layers positioned at either end of the second body include Weyl semimetal nanostructures and the third layer, sandwiched between the first and second layers, is formed from a phase change material. The Weyl semimetal nanostructures each have an optical property that controls the radiative heat transfer. The third layer is configured to transition between the insulating phase and metallic phase as a function of, or based on the temperature of the phase change material. The second body is independently rotatable.

At block 615, the third body is positioned to be spaced apart from the second body. The third body may be positioned a distance away from the second body that is equal to the distance that the second body is spaced apart from the first body. Further, the third body may be positioned along the common axis. The third body may be formed from and/or include a second plurality of Weyl semimetal nanostructures, each having an optical property that controls the radiative heat transfer. The third body is independently rotatable.

At block 620, in an optional step, the first body is rotated about the common axis with a rotation angle $\theta_1$ between 0 to $\pi$ (or 180 degrees) to change the optical property of each of the first plurality of Weyl semimetal nanostructures of the first body such that a mismatch in a permittivity of the optical properties of the second body and the first body and/or a mismatch in a permittivity of the optical properties of the third body and the first body is generated. The generated mismatch increases or decreases a near-field radiative heat transfer compared to a static state of the first body (e.g., $\theta_1=0$).

At block 625, in an optional step, the second body is rotated about the common axis with a rotation angle $\theta_2$ between 0 to $\pi$ (or 180 degrees) to change the optical property of each of the Weyl semimetal nanostructures of the first and second layers of the second body such that a mismatch in a permittivity of the optical properties of the second body and the first body is generated and/or a mismatch in a permittivity of the optical properties of the second body and the third body is generated. The generated mismatch increases or decreases a near-field radiative heat transfer compared to a static state of the second body (e.g., $\theta_2=0$).

At block 630, in an optional step, the third body is rotated about the common axis with a rotation angle $\theta_3$ between 0 to $\pi$ (or 180 degrees) to change the optical property of each of the second plurality of Weyl semimetal nanostructures of the third body such that a mismatch in a permittivity of the optical properties of the third body and the second body and/or the third body and the first body is generated. The generated mismatch increases or decreases a near-field radiative heat transfer compared to a static state of the third body (e.g., $\theta_3=0$).

It should be appreciated that the illustrative method 600 may continuously be executed and continuously loop such that the example thermal management system is continuous increasing or decreasing the near-field radiative heat transfer and/or there may be a rotation of any of the first body at block 620, the second body at block 625 and/or the third body at block 630 independently and without a combination of rotation. Therefore, for example, blocks 620 and 625 may be omitted if only the third body is rotated.

It should now be understood that the embodiments of this disclosure described herein provide a self-adaptive system based on a temperature for near-field radiative heat transfer in a three body system that utilizes phase change material in the middle body and rotation of a first body, a second body and/or a third body to change optical properties of a plurality of Weyl semimetal nanostructures of the first body, the second body and/or the third body to create a mismatch in a permittivity of the optical properties of the first body, the second body, and/or the third body.

The heat transfer from the first body to the third body through the second body is regulated in a self-adaptive manner dependent on the temperature and thus the phase of the vanadium dioxide in the second body, which changes with the heat received from the first body.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A thermal management system comprising:

a first body;

a second body having a first layer and a second layer formed from a Weyl semimetal and a third layer sandwiched between the first layer and the second layer, the third layer formed from a vanadium dioxide film, the second body spaced apart from the first body; and a third body spaced apart from the second body, wherein the second body is a modulator configured to transition between a metallic phase and an insulating phase dependent on a temperature to regulate a heat from the first body to the third body through the second body in a self-adaptive manner dependent on the temperature.

2. The thermal management system of claim 1, wherein the second body is positioned between the first body and the third body along a same axis.

3. The thermal management system of claim 1, wherein the first body is a heat source to transmit a heat.

4. The thermal management system of claim 3, wherein the second body receives the heat from the first body and modulates the heat received from the first body and the third body is a heat sink that receives the heat from the first body through the second body.

5. The thermal management system of claim 4 wherein:

when the heat received by the second body causes the second body to reach a temperature that is equal to or greater to a predetermined temperature, the second body automatically transitions to the metallic phase to reduce a heat transfer from the first body to the third body through the second body.

6. The thermal management system of claim 5 wherein:

when the heat received by the second body causes its temperature to be less than the predetermined temperature, the second body automatically transitions to the insulating phase to increase the heat transfer from the first body to the third body through the second body.

7. The thermal management system of claim 1 wherein the second body is configured to independently rotate with respect to the first body to change optical properties of the Weyl semimetal of the first layer or the second layer.

8. The thermal management system of claim 7, wherein the first body includes a first plurality of Weyl semimetal nanostructures and the third body includes a second plurality of Weyl semimetal nanostructures, the first body and the third body are each configured to independently rotate to change optical properties of the first plurality of Weyl semimetal nanostructures of the first body and optical properties of the second plurality of Weyl semimetal nanostructures of the third body.

9. The thermal management system of claim 8, wherein the rotation of the first body, the second body, or the third body, or changing a position of the rotated body such that the first body, the second body, and the third body switch between a symmetric arrangement and an asymmetric arrangement.

10. The thermal management system of claim 9, wherein the changes in the optical properties of the first and second layers of the second body and the second plurality of Weyl semimetal nanostructures of the third body create a mismatch in a permittivity of the optical properties to increase or decrease a near-field radiative heat transfer compared to a static state of the second body or the third body.

11. The thermal management system of claim 10, wherein the rotation of the first body, the second body and the third body is between 0 degrees and 180 degrees.

12. A method for forming a thermal management system, the method comprising:

positioning a first body having a first plurality of Weyl semimetal nanostructures;

positioning a second body spaced apart from the first body, the second body having a first layer and a second layer formed from a Weyl semimetal and a third layer sandwiched between the first layer and the second layer, the third layer formed from a vanadium dioxide film; and positioning a third body having a second plurality of Weyl semimetal nanostructures, wherein the second body is a modulator configured to transition between a metallic phase and an insulating phase dependent on a temperature to regulate a heat from the first body to the third body through the second body in a self-adaptive manner dependent on the temperature.

13. The method of claim 12, wherein the second body is positioned between the first body and the third body along a same plane.

14. The method of claim 12 wherein:

when a heat received by the second body causes the second body to reach a temperature that is equal to or greater to a predetermined temperature, the second body automatically transitions to the metallic phase to reduce a heat transfer from the first body to the third body through the second body.

15. The method of claim 14 wherein:

when the heat received by the second body causes its temperature to be less than the predetermined temperature, the second body automatically transitions to the insulating phase to increase the heat transfer from the first body to the third body through the second body.

16. The method of claim 12, further comprising:

rotating the second body, wherein the rotation of the second body changes optical properties of the Weyl semimetal of the first layer and the Weyl semimetal of the second layer; and independently rotating the third body, wherein the rotation of the third body changes optical properties of the second plurality of Weyl semimetal nanostructures.

17. The method of claim 16, wherein the first body and the third body are each configured to independently rotate to change optical properties of the first plurality of Weyl semimetal nanostructures of the first body and optical properties of the second plurality of Weyl semimetal nanostructures of the third body.

18. The method of claim 17, wherein the rotation of the first body, the second body or the third body or changing a position of the rotated body such that the first body, the second body, and the third body switch between a symmetric arrangement and an asymmetric arrangement.

19. A thermal management system comprising:

a first body configured as a heat source that transfers heat and has first plurality of Weyl semimetal nanostructures;

a second body having a first layer and a second layer formed from a Weyl semimetal and a third layer sandwiched between the first layer and the second layer, the third layer formed from a vanadium dioxide film, the second body spaced apart from the first body, the second body is a heat modulator configured to transition between a metallic phase and an insulating phase dependent on a temperature; and a third body having a second plurality of Weyl semimetal nanostructures, wherein the third body is spaced apart from the second body, the second body is positioned between the first body and the third body, the third body is a heat sink configured to receive the heat when the second body is in the insulating phase, wherein:

the second body is configured to regulate a heat from the first body to the third body through the second body in a self-adaptive manner dependent on the temperature, and the first body, the second body, and the third body are each configured to independently rotate with respect to a common axis to change optical properties of the first plurality of Weyl semimetal nanostructures, optical properties of the Weyl semimetal of the first layer and the second layer of the second body, and optical properties of the second plurality of Weyl semimetal nanostructures.

20. The thermal management system of claim 19, wherein:

when the heat received by the second body causes the second body to reach a temperature that is equal to or greater to a predetermined temperature, the second body automatically transitions to the metallic phase to reduce a heat transfer from the first body to the third body through the second body; and when the heat received by the second body causes its temperature to be less than the predetermined temperature, the second body automatically transitions to the insulating phase to increase the heat transfer from the first body to the third body through the second body.

* * * * *